US008449344B2

(12) United States Patent
Nuttall et al.

(10) Patent No.: US 8,449,344 B2
(45) **Date of Patent: *May 28, 2013**

(54) FOLDABLE VEHICLE PLAYSETS WITH MOVING COMPONENTS

(75) Inventors: Michael Nuttall, South Pasadena, CA (US); Harold Garner, El Segundo, CA (US); Stacy O'Connor, Long Beach, CA (US)

(73) Assignee: Mattle, Inc., El Segundo, CA (US)

( * ) Notice: Subject to any disclaimer, the term of this patent is extended or adjusted under 35 U.S.C. 154(b) by 120 days.

This patent is subject to a terminal disclaimer.

(21) Appl. No.: 13/007,965

(22) Filed: Jan. 17, 2011

(65) Prior Publication Data

US 2011/0130068 A1 Jun. 2, 2011

Related U.S. Application Data

(63) Continuation of application No. 11/744,771, filed on May 4, 2007, now Pat. No. 7,892,068.

(60) Provisional application No. 60/798,086, filed on May 4, 2006, provisional application No. 60/798,138, filed on May 4, 2006, provisional application No. 60/812,305, filed on Jun. 9, 2006.

(51) Int. Cl.
*A63H 33/04* (2006.01)

(52) U.S. Cl.
USPC ..... 446/75

(58) Field of Classification Search
USPC ..... 446/75
See application file for complete search history.

(56) References Cited

U.S. PATENT DOCUMENTS

| | | | | |
|---|---|---|---|---|
| 1,715,891 | A | | 6/1929 | Beck |
| 1,914,116 | A | | 6/1933 | Ford |
| 2,088,510 | A | | 7/1937 | Frasca |
| 2,992,598 | A | | 7/1961 | Einfalt |
| 3,108,398 | A | | 10/1963 | Einfalt |
| 3,235,259 | A | | 2/1966 | Glass et al. |
| 3,477,172 | A | | 11/1969 | Polewski |
| 3,502,332 | A | * | 3/1970 | Wolf ..... 463/69 |
| 3,510,631 | A | | 5/1970 | Weinberg et al. |

(Continued)

FOREIGN PATENT DOCUMENTS

| | | | |
|---|---|---|---|
| GB | 2159721 | A | 12/1985 |
| GB | 2178331 | A | 2/1987 |

(Continued)

OTHER PUBLICATIONS

US Receiving Office, International Search Report regarding PCT Application No. PCT/US2007/68287, Aug. 22, 2008, 2 pages.

(Continued)

*Primary Examiner* — Michael Dennis
(74) *Attorney, Agent, or Firm* — Kolisch Hartwell, PC

(57) ABSTRACT

Vehicle playsets having multiple configurations. The vehicle playsets may include a track segment, a trigger adjacent to the track segment, a moving component adapted to move toward the trigger, and a launch mechanism coupled to the track segment and adapted to launch a toy vehicle along the track segment toward the moving component. Striking the moving component with the toy vehicle may prevent the moving component from reaching the trigger. The playset may include at least two configurations including a closed configuration and an open configuration that is suitable for play.

25 Claims, 5 Drawing Sheets

U.S. PATENT DOCUMENTS 3,531,118 A 9/1970 Mabie et al.
3,545,757 A 12/1970 Tepper et al.
3,559,334 A 2/1971 Beny et al.
3,599,365 A 8/1971 Carver et al.
3,621,602 A 11/1971 Barcus et al.
3,713,654 A 1/1973 Goldfarb
3,769,743 A * 11/1973 Benkoe et al. ..... 446/3
3,814,021 A 6/1974 McHenry
3,856,304 A 12/1974 Matsumoto et al.
3,883,987 A 5/1975 Joshi et al.
3,908,989 A 9/1975 Meyer
3,926,434 A 12/1975 Cannon, Jr.
3,952,442 A 4/1976 Livesey et al.
4,094,089 A 6/1978 Sano
4,247,107 A 1/1981 Smith, III et al.
4,249,733 A 2/1981 Eddins et al.
4,349,983 A 9/1982 Kilroy et al.
4,364,566 A 12/1982 Neuhierl
4,383,688 A 5/1983 Prehodka
4,423,871 A 1/1984 Mucaro
4,472,906 A 9/1984 Cook et al.
4,479,326 A 10/1984 Kennedy et al.
4,504,242 A 3/1985 Crain et al.
4,513,967 A * 4/1985 Halford et al. ..... 273/108
4,519,789 A 5/1985 Halford et al.
4,536,168 A 8/1985 Stephens
4,558,867 A 12/1985 Hippely
4,575,350 A 3/1986 Hippely et al.
4,642,066 A 2/1987 Kennedy et al.
4,661,080 A 4/1987 Goldstein et al.
4,732,569 A 3/1988 Hippely et al.
4,898,404 A 2/1990 Babcock
4,937,207 A 6/1990 Simmell et al.
4,946,413 A 8/1990 Lehmann et al.
4,961,716 A 10/1990 Hippely et al.
4,999,604 A 3/1991 Crews
5,038,685 A 8/1991 Yoneda et al.
5,234,216 A 8/1993 Ostendorff
5,299,969 A 4/1994 Zaruba
5,435,553 A 7/1995 Arima et al.
5,542,668 A 8/1996 Casale et al.
5,586,923 A 12/1996 Hippely et al.
5,643,040 A 7/1997 Hippely et al.
5,820,126 A 10/1998 Moore
5,839,937 A 11/1998 Thomas
5,961,149 A 10/1999 Hunt
5,970,882 A 10/1999 Smith et al.
6,089,951 A 7/2000 Ostendorff
6,099,380 A 8/2000 Rasmussen
6,146,238 A 11/2000 Daiber
6,216,600 B1 4/2001 Verret
6,280,286 B1 8/2001 Andrews
6,358,112 B1 3/2002 Lambert et al.
6,554,685 B2 4/2003 Lish
6,572,436 B1 6/2003 So
6,913,508 B2 * 7/2005 Hornsby et al. ..... 446/438
7,892,068 B2 2/2011 Nuttall
2005/0191940 A1 9/2005 Sheltman et al.
2005/0287918 A1 12/2005 Sheltman et al.

FOREIGN PATENT DOCUMENTS

GB 2200297 A 8/1988
GB 2159721 B 12/1988
GB 2200297 B 5/1990

OTHER PUBLICATIONS

US Receiving Office, Written Opinion of the International Searching Authority regarding PCT Application No. PCT/US2007/68287, Aug. 22, 2008, 3 pages.
US Receiving Office, International Preliminary Report on Patentability regarding PCT Application No. PCT/US2007/68287, Nov. 4, 2008, 4 pages.
US Patent and Trademark Office, Office Action regarding U.S. Appl. No. 11/744,771, Aug. 3, 2009, 5 pages.
US Patent and Trademark Office, Office Action regarding U.S. Appl. No. 11/744,771, Nov. 10, 2009, 34 pages.
US Patent and Trademark Office, Office Action regarding U.S. Appl. No. 11/744,771, Apr. 23, 2010 , 11 pages.

* cited by examiner

FOLDABLE VEHICLE PLAYSETS WITH MOVING COMPONENTS

RELATED APPLICATIONS

This application is a continuation of U.S. patent application Ser. No. 11/744,771, filed May 4, 2007, and entitled FOLDABLE VEHICLE PLAYSETS WITH MOVING COMPONENTS, which application claims the benefit of priority under 35 U.S.C. §119(e) of provisional patent application Ser. No. 60/798,086, titled FOLDING TRACK ASSEMBLIES, filed May 4, 2006; provisional patent application Ser. No. 60/798,138, titled FOLDABLE VEHICLE PLAYSETS WITH AUTOMATED MOVING COMPONENTS, filed May 4, 2006; and provisional patent application Ser. No. 60/812,305, titled FOLDABLE VEHICLE PLAYSETS WITH AUTOMATED MOVING COMPONENTS, filed Jun. 9, 2006; each of which is incorporated herein by reference in its entirety for all purposes.

BACKGROUND

Playsets for toy vehicles may include linear segments. Such linear segments may result in a toy that must either be assembled for use and disassembled for storage, or that is difficult to transport and store by virtue of its length and size.

Playsets for toy vehicles may include track segments that are substantially straight, and/or include sections of track that are sufficiently long that the resulting playset must both be assembled for use and disassembled for storage. Additionally, the playset may be difficult to transport and store.

It would be advantageous to have substantially self-contained vehicle playsets that can be readily stored and/or transported without disassembly, can be readily converted to an operable configuration, and offer exciting play opportunities.

Examples of foldable vehicle playsets can be found in the disclosures of U.S. Pat. Nos. 6,572,436, 6,554,685, 6,146,238, 6,099,380, 5,961,149, 5,839,937, 4,946,413, 4,937,207, 4,898,404, 4,349,983, 3,108,398, 1,914,116, and UK Patents GB002178331 and GB002159721. Examples of vehicle tracksets with movable components include U.S. Pat. Nos. 6,089,951, 5,970,882, 5,542,668, 5,435,553, 5,299,969, 4,999,604, 4,661,080, 4,642,066, 4,536,168, 4,504,242, 4,479,326, 4,472,906, 4,423,871, 4,364,566, 4,247,107, 3,926,434, 3,531,118, 3,510,631, and 2,992,598. Examples of articulated toy figures responsive to impact can be found in U.S. Pat. Nos. 6,280,286, 3,856,304, 3,235,259, 2,088,510, and the classic "Rock'Em Sock'Em Robots" game by Mattel, Inc. Examples of playsets in which a mechanical figure advances along a track can be found in U.S. Pat. Nos. 3,599,365, 3,545,757, and 3,477,172. The disclosures of all of the patents, patent applications, and publications recited herein are incorporated herein by reference.

DETAILED DESCRIPTION

The present disclosure is directed to vehicle playsets having multiple configurations. The vehicle playset may have a closed configuration suitable for storage and/or transportation, and an open configuration suitable for play. The vehicle playset may include a trackway adapted to be traversed by a toy vehicle, and may include one or more moving components. More specifically, the vehicle playsets may include one or more moving components configured to exhibit a response to impact, such as with the toy vehicle.

The vehicle playsets may include a track segment, a trigger adjacent to the track segment, a moving component adapted to move toward the trigger, and a launch mechanism coupled to the track segment and adapted to launch a toy vehicle along the track segment toward the moving component. Striking the moving component with the toy vehicle may prevent or otherwise hinder the moving component from reaching the trigger.

Figure 1:
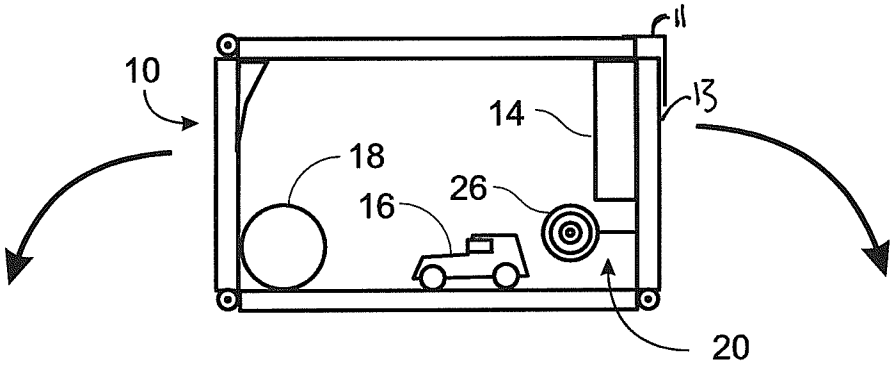
FIG. 1 schematically depicts an exemplary vehicle playset in a closed configuration.
Figure 2:
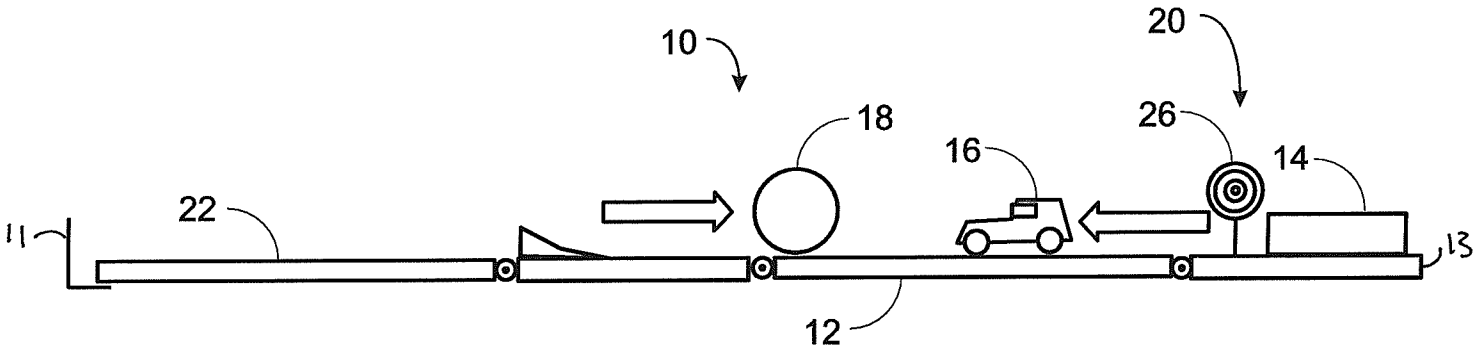
FIG. 2 schematically depicts the exemplary vehicle playset of FIG. 1 in a closed configuration.

An exemplary folding vehicle playset 10 is shown schematically in FIGS. 1 and 2. The vehicle playsets of the disclosure typically possess at least two configurations, with at least one configuration being a "closed" configuration, as shown in FIG. 1, and at least one configuration being an "opened" configuration, as shown in FIG. 2.

Vehicle playset 10 is shown in an exemplary closed configuration in FIG. 1. The track segments of the vehicle playset are shown folded to create a more compact structure that is more readily transportable. The track segments may be folded back and alongside of each other. Alternatively, the track segments may be folded up and over the vehicle playset. In one embodiment, the track segments fold up and over the vehicle playset, and the ends of the track segments 11, 13 positively interact, such as by interlocking or snapping together. One or more components of the vehicle playset may be reconfigured in order to further facilitate folding of the track assembly. The interlocked track segments may double as a carrying handle for the closed vehicle playset.

The opened configuration is a configuration of the vehicle playset that is operable; that is, the vehicle playset is configured for play. A given vehicle playset may have one or more closed configurations, and one or more open configurations. A vehicle playset may additionally have one or more intermediate configurations, where a portion of track is in an intermediate position between its open and closed positions, or alternatively, where less than all of the track portions are in an open configuration.

The vehicle playset may be configured to represent a particular environment or venue. The track assembly may include one or more licensed characters, such as a superhero, good-guy, villain, television personality, comic character, or the like. The track assembly may be sized and adapted for use with a particular type of toy vehicle, such as skateboards, bicycles, motorcycles, trains, cars, or trucks. In a particular embodiment, the track assembly is configured to be compatible with HOT WHEELS toy vehicles.

When in the closed configuration, the various elements of the vehicle playset may create a diorama that evokes the theme of the vehicle playset. The closed configuration may be decoratively shaped or otherwise configured, such as to resemble a diorama, a scene from a film, a billboard or any desired reduced-scale structure, and so forth, with one or more components of the playset serving a structural and/or decorative purpose while in the display or storage configuration. For example, structure resembling a tower in the unfolded play configuration may be folded horizontally to serve as a carrying handle in the folded display or storage configuration. In another embodiment, the display or storage configuration may be enclosed into a box or other container-like structure with decorative indicia adorning the outer surface.

Exemplary vehicle playset 10 is shown in an open configuration in FIG. 2. The playset includes a track 12, a launcher 14 for a toy vehicle 16, and a moving component 18. In some embodiments, track 12 may be adapted to be traversed by a toy vehicle. The track may incorporate a length of straight track, shaped track, a circuit or loop, or any other desired layout. Playset 10 may further include an exit segment 22, which may serve as a destination for the toy vehicle.

The vehicle playset may be adapted so that toy vehicle 16 may strike moving component 18. Alternatively, or in addition, the playset may be adapted so that toy vehicle 16 must avoid striking moving component 18, for example in order to reach exit segment 22. The movement of component 18 may be utilized during play as a timing element. That is, one or more actions by the user must be completed before component 18 reaches a specified target 20.

The vehicle playset may include one or more additional components adapted to divert a toy vehicle, capture a toy vehicle, or launch a toy vehicle. Alternatively, the additional component may be adapted to exhibit a response to an impact, such as with the toy vehicle. The nature and structure of such additional components may vary as desired, for example to allow a user to re-create a scene from a movie, participate in a realistic or fantastic adventure scenario, imagine a play setting of his or her own choice, and so forth.

In operation, toy vehicle 16 may be placed in or upon launcher 14, and subsequently propelled down track 12. The launcher may incorporate any of various mechanisms for providing a motive force to the toy vehicle such as a booster, a gravity feed, and so forth. For example, launcher 14 may raise an initial track segment so that the vehicle rolls down track 12 under the influence of gravity. Alternatively, the launch mechanism may include a spring or other resilient member that may be flexed, compressed, or otherwise biased, so that when it is released the toy vehicle is propelled along track 12. In yet another embodiment, the launch mechanism involves a simple mechanical advantage, such that by pressing on a lever or toggle, the toy vehicle is launched. In yet another embodiment, the launch mechanism may incorporate a bellows or other pneumatic driver, so that striking or otherwise compressing the bellows propels the toy vehicle via air pressure. Such devices may be manually operable, for example via a hand crank or user-operated release gate, or battery-powered, or otherwise configured.

For example, the moving component may be directed at a target 26. The vehicle playset may be adapted so that under the desired conditions, the toy vehicle may strike the moving component and thereby prevent the moving component from reaching the target. The user may be required to time the launch of the toy vehicle in order to intercept the moving component, thereby bringing an element of skill into play.

The effect of striking the moving component may vary. For example, striking the moving component with the toy vehicle may result in the moving component being displaced from the vehicle playset entirely or at least displaced from the track leading to the target. Alternatively, or in addition, striking the moving component may delay the progress of the component, or drive it backwards along its track. A successful strike on the moving component may be accompanied by sound and/or light effects.

The exit segment may include one or more exit features. For example, the exit segment may terminate with a ramp or jump, so that a car that successfully traverses the vehicle playset is launched into the air. Alternatively, the exit track segment may include a trigger, which when activated by a vehicle, may initiate an action. The action may include being captured or retained by an additional mechanism, an additional launch mechanism to propel the toy vehicle backward along the vehicle track, among others.

Various aspects of the operation of the vehicle playset may be accompanied by prerecorded or electronically generated sounds. In particular, actions such as activation of the moving component, or launching the toy vehicle, or mechanisms such as capture features, or diversion features may be accompanied by sound effects. The sound effects may include music samples. The sound effects may include speech, either recorded or synthesized. The recorded speech may include sound effects consistent with the action of the vehicle playset.

In order to provide an impetus for any or all of the launch and/or track features or other moving portions of the vehicle playset, the vehicle playset is typically first energized. The playset may rely upon gravity to activate or motivate one or more features. Alternatively, or in addition, the playset may be energized for example by winding up a spring, flexing a resilient member, or stretching an elastic member. Typically, such a track feature is energized by the user. Alternatively, the vehicle playset may incorporate one or more motors with associated power sources so that a given feature may be activated without requiring the corresponding mechanism to be energized by the user first.

Figure 3:
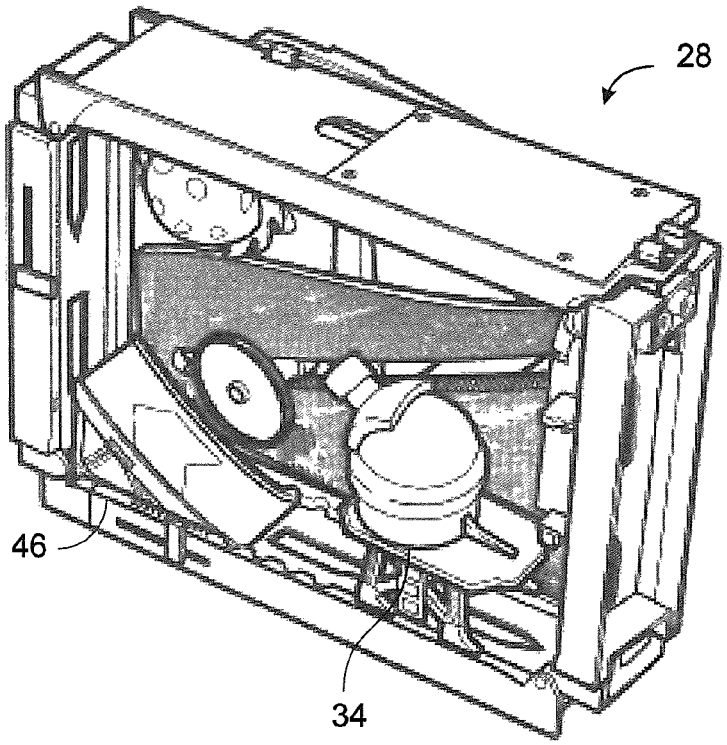
FIG. 3 is a perspective view of an alternative exemplary vehicle playset in a closed configuration.
Figure 4:
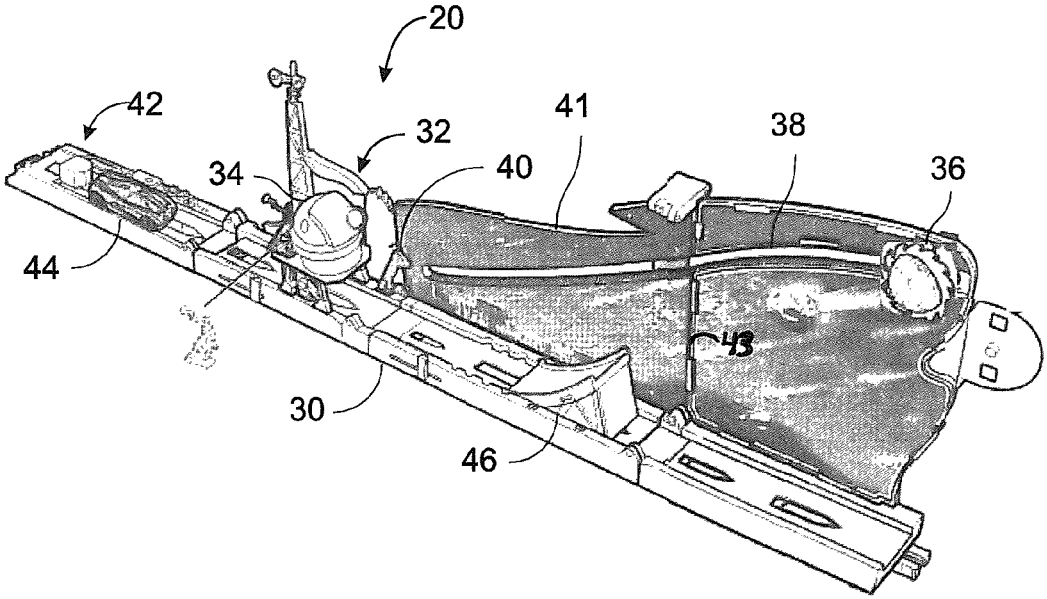
FIG. 4 is a perspective view of the alternative exemplary vehicle playset of FIG. 3 in an open configuration.

An exemplary embodiment of the disclosed vehicle playset is depicted in FIG. 3 and FIG. 4. Various components of vehicle playset 28 are collectively configured to represent a race to an astronomical observatory, concomitant with the crash of a falling asteroid. For example, central track segment 30 includes a target 32 that resembles an astronomical observatory 34. The vehicle playset also includes a moving component in the form of asteroid 36 that is adapted to move along guide track or channel 38 until it makes contact with trigger 40 of target 32. When moving component asteroid 36 reaches trigger 40, the observatory may be ejected from the central track segment, such as to represent the result of an asteroid crashing into the Earth. The ejection of the observatory may alternatively be triggered by a switch or a timer.

In the exemplary playset of FIGS. 3 and 4, the guide channel is defined by a playset backboard 41, and has the form of an inclined slot. The playset back board 41 may include a folding line 43 (FIG. 4) along which the playset backboard 41 may be folded for storage (FIG. 3). The moving component is adapted to roll along the guide channel under the influence of gravity. In order to prevent the destruction of observatory 34, the user may first cock the launch mechanism 42, and then permit asteroid 36 to begin rolling and spinning down the guide channel 38. The user may then time the triggering of the launch of vehicle 44 down the central track segment so that vehicle 44 strikes asteroid 36. The guide channel may be shaped so as to create a window of opportunity for vehicle 44 to strike asteroid 36 and prevent it from hitting trigger 40 of target 32. Alternatively, ramp 46 may be positioned along the track segment so that a carefully launched toy vehicle can intercept the asteroid during its descent. Ramp 46 may be adapted to be placed in one of a plurality of discrete positions along the track, or the playset may be configured to that the ramp may be placed continuously along the track. In one embodiment, when toy vehicle 44 strikes moving component asteroid 36, the asteroid may be detached from the playset as a result of the collision.

In an alternative mode of gameplay, the descent of asteroid 36 may be initiated, and toy vehicle 44 may be required to pass under and/or through target 32 before asteroid 36 makes contact with trigger 40, or the track may become blocked and/or the toy vehicle may be diverted from the track.

Figure 5:
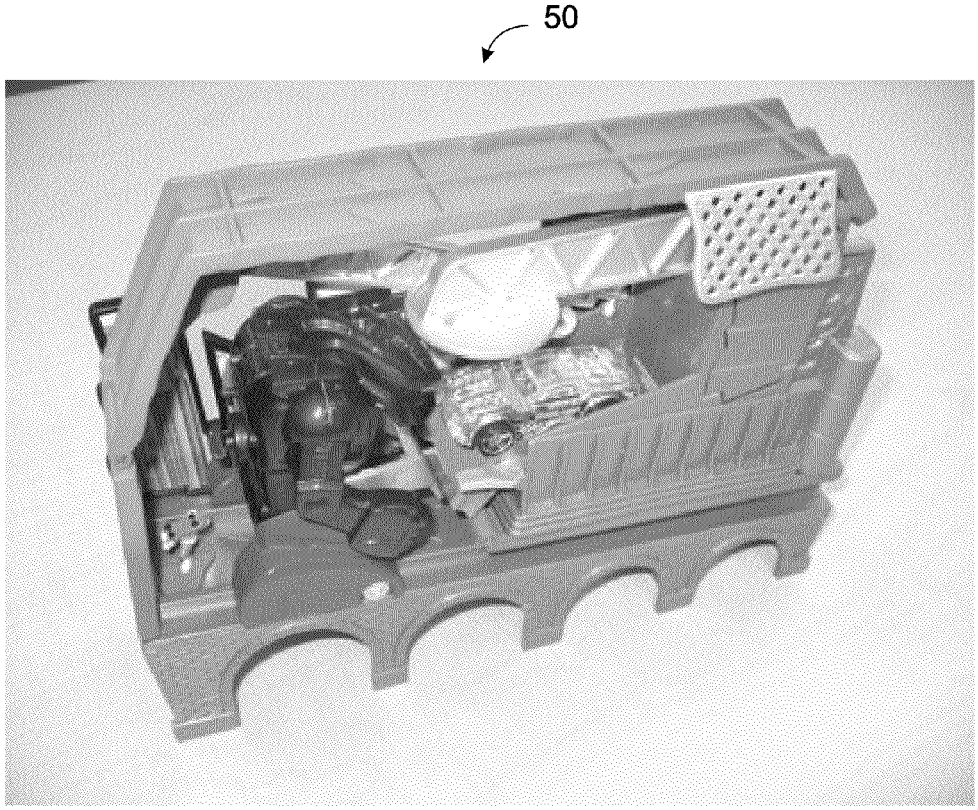
FIG. 5 is a perspective view of yet another alternative exemplary vehicle playset in a closed configuration.
Figure 6:
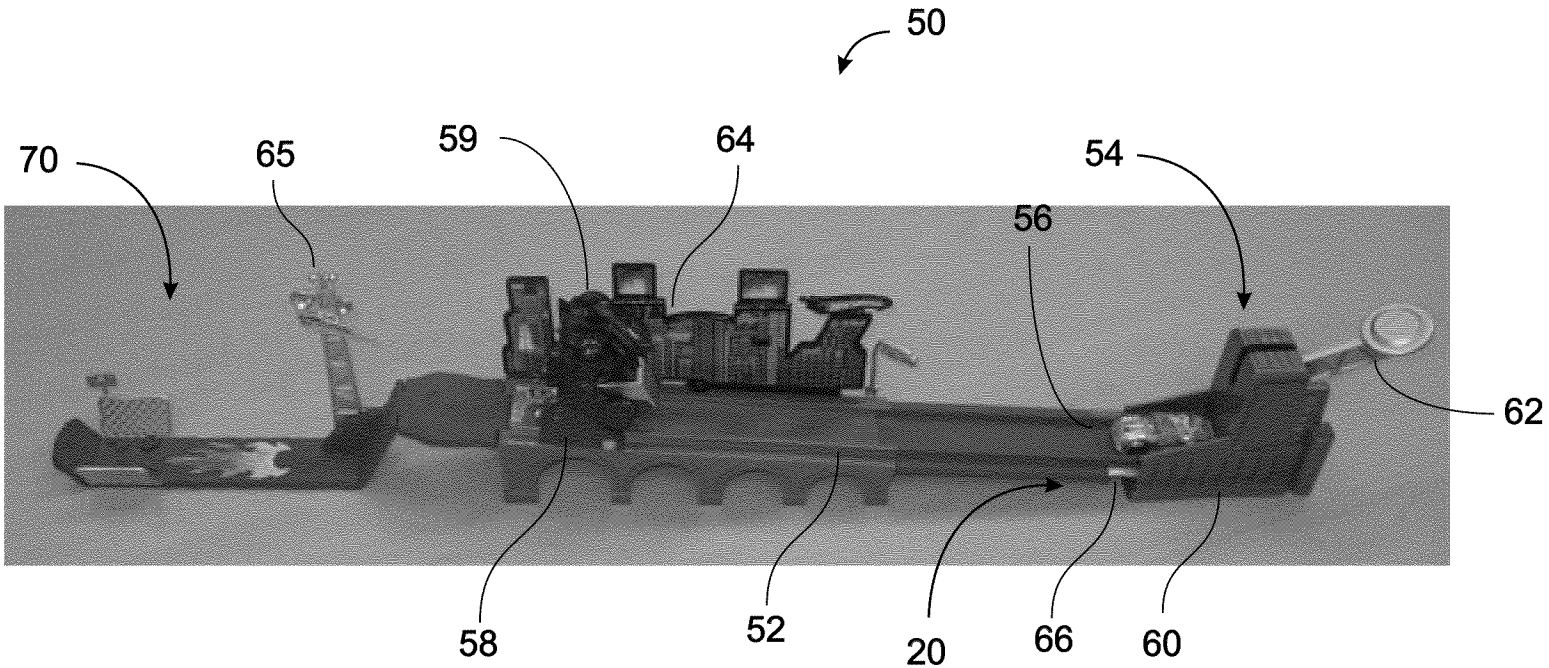
FIG. 6 is a perspective view of the alternative exemplary vehicle playset of FIG. 5 in an open configuration.

An alternative exemplary vehicle playset 50 is shown in a closed configuration in FIG. 5 and in open configuration in FIG. 6. Playset 50 includes a track 52, a launcher 54 for a toy vehicle 56, and a moving component 58. Track 52 may be adapted to be traversed by toy vehicle 56, arriving at exit segment 70.

Vehicle playset 50 may incorporate stylistic elements in order to evoke a fictional cityscape under siege by a giant robot. As such, moving component 58 may be configured to resemble an articulated robot FIG. 59. Launcher 54 may be incorporated in a structure 60 adapted to resemble a gas or service station, a warehouse, powerplant, or similar structure. Structure 60 may include decorative structure such as simulated gasoline pumps, doors, windows, and so forth. Structure 60 may include a user-operated launching device, which may be operable via a handle 62 protruding from structure 60.

Track 52 may extend from structure 60 through a simulated cityscape, as may be indicated by a backdrop 64 and one or more structures 65 that may be adapted to resemble various urban features such as a bridge, a tower, and/or a junkyard.

Figure 7:
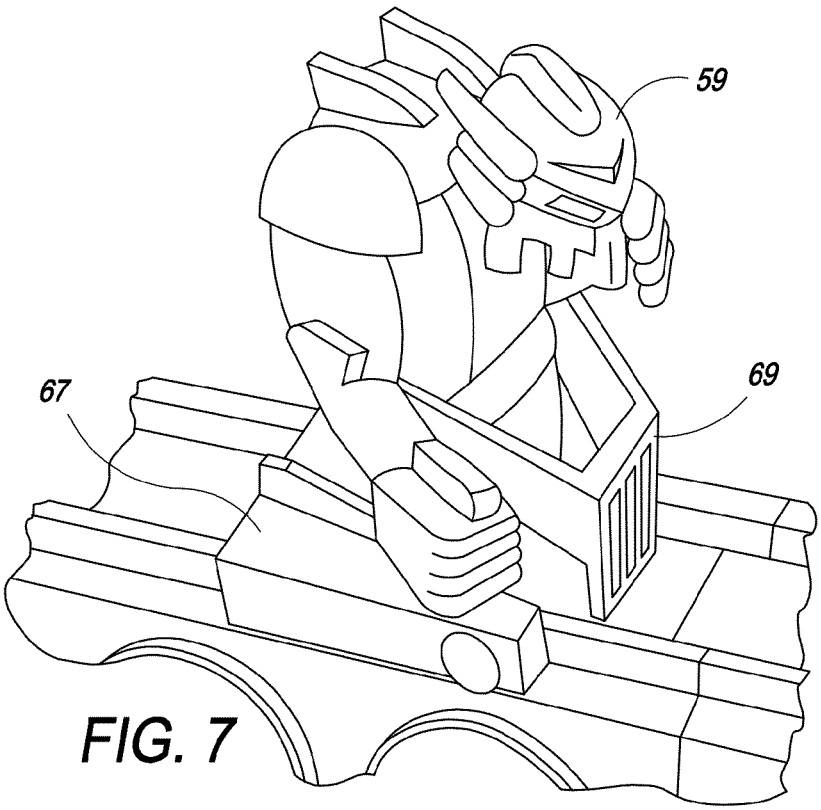
FIG. 7 is a perspective view of a moving component in the form of a robot with a shield in a lowered position.
Figure 8:
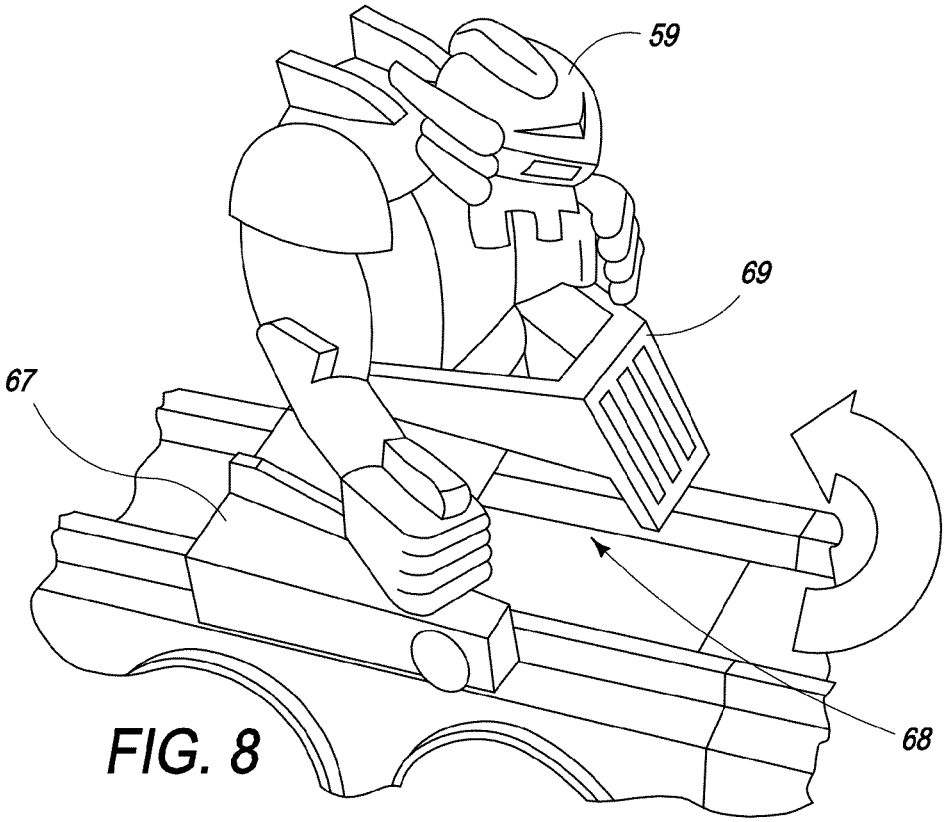
FIG. 8 is a perspective view of the moving component of FIG. 7, with the shield in a raised position.

Moving component 58 may be adapted for automated movement such as movement along track 52 towards a target 20 incorporated in or adjacent to structure 60. The robot FIG. 59 may include movable arms or similar structure configured to knock toy vehicles from track 52 as the figure moves forward. In one embodiment, as shown in FIGS. 7 and 8, robot FIG. 59 is adapted to straddle track 52. The robot figure may include one or more mechanisms for imparting translational movement of the robot figure along the track, such as a base 67 that includes a plurality of wheels. The robot figure may be roughly humanoid, for example including two arms and a head interconnected by a torso that may be disposed on the wheeled base. Any of the various parts of the robot may be articulated and configured for independent movement. For example, the torso may automatically raise and lower, the arms may swing, the head may rear back and thrust forward, etc., and the figure may include one or more internal mechanisms configured to move one or more robot parts in a random or pseudorandom manner, either when the robot figure is moving along the track or when it is stationary. Such internal mechanisms may be further configured to move the robot in either direction along the track in a similar manner, to enhance the appearance of a robot figure that is attacking the city, demolishing buildings and knocking vehicles from the track.

The wheeled base 67 of the robot figure may define an archway 68 adapted to allow the passage of a toy vehicle on the track underneath the robot figure. The robot figure may additionally include a shield 69 configured to partially or completely obstruct archway 68. The movement of the shield may be driven by the aforementioned internal mechanisms, and may be random, pseudorandom, or patterned. The shield may also serve as a trigger mechanism such that when struck by an object—such as a toy vehicle traversing the track—the robot figure is knocked from, or backwards along, the trackway. Some or all of the aforementioned movements of the robot figure may be powered by a power source such as a motor, which may be battery-powered, spring-driven, or otherwise configured, as desired.

Structure 60 may be adapted to move, or one or more components of structure 60 may be animated, when trigger 66 is activated. The trigger may be activated by depressing a switch, actuating a proximity detection device, breaking a light beam, and so forth. Such an event may trigger one or more outputs such as a light display or sound effect, and/or the activation of a spring-loaded or otherwise actuated movement of a structural component such as a piece of pop-up structure. For example, upon activation of trigger 66, a panel of structure 60 may be released to open or pop free and may be accompanied by a light and sound display, all of which may collectively simulate an explosion signifying the destruction of structure 60.

During play, the user may launch one or more toy vehicles along track 52 in an attempt to accomplish one or more of a variety of goals.

For example, the user may attempt to impede the progress of robot FIG. 59 by launching a toy vehicle along the track to strike the figure. The robot figure may include a target which, if successfully struck by a toy vehicle, may cause the robot figure to be displaced or dislodged from track 52. For example the user may be required to correctly calculate the timing required to strike a moving target structure, due to the movement of the target structure, the robot's appendages, and/or the translational movement of the robot figure itself along the track. If the user launches a toy vehicle at an inopportune moment, the toy vehicle may either be knocked from the trackway by the robot figure, or pass unimpeded underneath the robot, along the remaining length of trackway, and into the simulated junkyard. However, if the user is able to successfully strike the target structure at the proper moment, the robot figure may fall over or be otherwise dislodged, allowing the user to simulate the experience of successfully saving the city from destruction.

Alternatively, or in addition, the user may strike robot FIG. 59 one or more times in an effort to drive the robot figure backward along the trackway and/or fall over. In particular, the user may be required to judge the timing of the movement of shield 69 in order to strike the robot figure and drive it backwards. If shield 69 is in a raised position (as shown in FIG. 8) when the toy vehicle may be launched, the vehicle may pass through archway 68, leaving the robot figure unhindered. After each successful impact, the toy vehicle may roll back to launcher 54. Track 52 may be inclined slightly toward structure 60 in order to facilitate return of the vehicle to the launcher. In this manner, repeated collisions between a toy vehicle and the robot figure may result in the robot figure being knocked further and further away from structure 60, and eventually completely off of the trackway, optionally onto an exit segment 70.

Alternatively, or in addition, the user may launch a toy vehicle along track 52 in an attempt to avoid the robot FIG. 59, and escape to exit segment 70, leaving the robot figure to "destroy" structure 60 by reaching trigger 66 unopposed.

Other components of the playset may include one or more small human figurines, and/or additional structure that may be releasably attached to the structural components of the cityscape such as traffic signs, and so forth. The robot figure may be configured to exhibiting movement to simulate that it has been defeated. For example, a strike plate may be disposed in the robot figure's mouth, or elsewhere on the robot figure as appropriate, which may be configured to open and/or close.

Additional components and structural features of such a playset may further enhance the user's play experience. For example, the playset described above may further include pop-up or fold-out structure configured to spring open when actuated, such as if the robot advances over a trigger switch on the trackway. As such, the pop-up or fold-out structure may resemble pieces of buildings exploding or being destroyed.

The disclosed vehicle playsets may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like.

The disclosed vehicle playsets offer a number of advantageous properties. The vehicle playsets may be substantially self-contained, they can be readily converted to an operable configuration without requiring disassembly or reassembly, and they may offer an exciting play experience.

Although the present invention has been shown and described with reference to the foregoing operational principles and preferred embodiments, it will be apparent to those skilled in the art that various changes in form and detail can be made without departing from the spirit and scope of the invention. For example, although the vehicle playset is depicted and described as having a particular sequence of track segments, moving components, targets, and other features, any suitable combination of track segments and/or features may be utilized to form the disclosed vehicle playsets. The present invention is intended to embrace all such alternatives, modifications and variances that fall within the scope of the appended claims.

What is claimed is:

1. A playset for toy vehicles, comprising:

a track segment having a first end and a second end;

a trigger adjacent to the track segment between the first end and the second end;

a moving component adapted to move along the track segment, in a direction from the second end toward the trigger; and a launch mechanism coupled to the track segment at the first end and adapted to launch a toy vehicle along the track segment toward the moving component;

wherein the trigger is adjacent to the track segment between the launch mechanism and the moving component and striking the moving component with the toy vehicle hinders the moving component from reaching the trigger; and wherein the playset is pre-assembled to have at least two foldably interchangeable configurations including a closed configuration suitable for storage in which the first end and the second end of the track segment positively interact with each other and an open configuration suitable for play.

2. The vehicle playset of claim 1, wherein at least a portion of the track segment is inclined toward the launch mechanism.

3. The vehicle playset of claim 1, wherein the moving component is configured to be dislodged from the playset when struck by the toy vehicle.

4. The vehicle playset of claim 1, wherein the moving component includes a base that defines an archway.

5. The vehicle playset of claim 1, wherein the moving component includes a shield configured to intermittently obstruct an archway.

6. The vehicle playset of claim 5, wherein when the shield obstructs the archway the toy vehicle launched along the track will strike the shield.

7. The vehicle playset of claim 5, wherein the shield is configured to animate when the moving component strikes the shield.

8. The vehicle playset of claim 5, wherein a portion of the moving component is configured to be ejected from the playset when the toy vehicle strikes the shield.

9. The vehicle playset of claim 5, wherein the moving component is configured to be ejected from the playset when the toy vehicle strikes the shield.

10. A playset for toy vehicles, comprising:

a track segment having a first end and a second end;

a trigger adjacent to the track segment between the first end and the second end;

a moving component adapted to move along the track segment, in a direction from the second end toward the trigger; and a launch mechanism coupled to the track segment at the first end and adapted to launch a toy vehicle along the track segment toward the moving component;

wherein striking the moving component with the toy vehicle hinders the moving component from reaching the trigger; and wherein the track segment is foldable at three or more points along its length to permit the track to be configured in either a generally rectangular closed configuration and a substantially linear open configuration suitable for play.

11. The vehicle playset of claim 10, further comprising an exit segment coupled to the track segment and configured to receive the toy vehicle from the track segment.

12. The vehicle playset of claim 10, wherein the moving component is configured to be dislodged from the playset when struck by the toy vehicle.

13. The vehicle playset of claim 10, further comprising a target configured to animate when the moving component activates the trigger.

14. The vehicle playset of claim 13, wherein the target is configured to be ejected from the playset when the moving component activates the trigger.

15. The vehicle playset of claim 13, wherein a component of the target is configured to change conformation when the moving component activates the trigger.

16. The vehicle playset of claim 10, wherein the first end and the second end of the track segment positively interact with each other in the closed configuration.

17. The vehicle playset of claim 10, wherein at least a portion of the track segment is inclined toward the launch mechanism.

18. A playset for toy vehicles, comprising:

a track segment having a first end and a second end;

a trigger adjacent to the track segment between the first end and the second end;

a moving component adapted to move along the track segment, in a direction from the second end toward the trigger; and a launch mechanism coupled to the track segment at the first end and adapted to launch a toy vehicle along the track segment toward the moving component;

wherein striking the moving component with the toy vehicle hinders the moving component from reaching the trigger; and wherein the track segment is foldable at at least one point and is pre-assembled to have at least two foldably interchangeable configurations including a closed configuration suitable for storage in which the first end and the second end of the track segment positively interact with each other and an open configuration suitable for play.

19. The vehicle playset of claim 18, further comprising an exit segment coupled to the track segment and configured to receive the toy vehicle from the track segment.

20. The vehicle playset of claim 18, wherein the moving component is configured to be dislodged from the playset when struck by the toy vehicle.

21. The vehicle playset of claim 18, further comprising a target configured to animate when the moving component activates the trigger.

22. The vehicle playset of claim 21, wherein the target is configured to be ejected from the playset when the moving component activates the trigger.

23. The vehicle playset of claim 21, wherein a component of the target is configured to change conformation when the moving component activates the trigger.

24. The vehicle playset of claim 18, wherein at least a portion of the track segment is inclined toward the launch mechanism.

25. The vehicle playset of claim 18, wherein the track segment is foldable at three points to substantially form a rectangle in the closed configuration.

* * * * *